US011673401B2

(12) United States Patent
Hara

(10) Patent No.: US 11,673,401 B2
(45) **Date of Patent: *Jun. 13, 2023**

(54) LIQUID SUPPLY DEVICE AND LIQUID DISCHARGE DEVICE

(71) Applicant: TOSHIBA TEC KABUSHIKI KAISHA, Tokyo (JP)

(72) Inventor: Kazuhiro Hara, Numazu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/507,003

(22) Filed: Oct. 21, 2021

(65) Prior Publication Data

US 2022/0040990 A1 Feb. 10, 2022

Related U.S. Application Data

(63) Continuation of application No. 16/750,945, filed on Jan. 23, 2020, now Pat. No. 11,179,945.

(30) Foreign Application Priority Data

Mar. 19, 2019 (JP) ..... JP2019-051160

(51) Int. Cl.
*B41J 2/175* (2006.01)
*B41J 2/17* (2006.01)
*B41J 2/19* (2006.01)

(52) U.S. Cl.
CPC ..... *B41J 2/17563* (2013.01); *B41J 2/1707* (2013.01); *B41J 2/17596* (2013.01); *B41J 2/19* (2013.01)

(58) Field of Classification Search
CPC .. B41J 2/17563; B41J 2/1707; B41J 2/17596; B41J 2/19
See application file for complete search history.

(56) References Cited

U.S. PATENT DOCUMENTS 4,460,904 A 7/1984 Oszczakiewicz et al.
4,591,870 A 5/1986 Braun et al.
(Continued)

FOREIGN PATENT DOCUMENTS

EP 0216912 B1 3/1990
EP 3072696 A1 9/2016
(Continued)

OTHER PUBLICATIONS

Japanese Notice of Reasons for Refusal dated Jul. 5, 2022 in corresponding Japanese Patent Application No. 2019-051160, 6 pages (with Translation).
(Continued)

*Primary Examiner* — Thinh H Nguyen
(74) *Attorney, Agent, or Firm* — Kim & Stewart LLP

(57) ABSTRACT

A liquid supply device includes a first conduit, a second conduit, one or more pumps, a heater, a filter, and a bypass conduit. The first conduit is connected to an upstream side of a liquid discharge head. The second conduit is connected to a downstream side of the liquid discharge head. The liquid is supplied through the first conduit to the liquid discharge head and recovered from the liquid discharge head through the second conduit. The heater is provided along the first conduit. The filter is provided in the first conduit on a downstream side of the heater. The bypass conduit is connected between a portion of the first conduit upstream with respect to the filter and a portion of the second conduit.

20 Claims, 5 Drawing Sheets

(56) References Cited

U.S. PATENT DOCUMENTS

| | | | | |
|---|---|---|---|---|
| 4,875,055 | A | 10/1989 | McCann et al. | |
| 8,684,507 | B2 * | 4/2014 | Uezawa | B41J 29/02 347/89 |
| 2014/0240406 | A1 | 8/2014 | LaCaze et al. | |
| 2016/0001568 | A1 | 1/2016 | Kamei et al. | |
| 2016/0279964 | A1 | 9/2016 | Ando | |
| 2018/0170066 | A1 | 6/2018 | Ohtsu et al. | |

FOREIGN PATENT DOCUMENTS

| | | | |
|---|---|---|---|
| EP | 3339039 | A1 | 6/2018 |
| JP | 2009-269360 | A | 11/2009 |
| JP | 2016-182725 | A | 10/2016 |

OTHER PUBLICATIONS

Extended European Search Report dated Aug. 11, 2020 mailed in corresponding European Patent Application No. 20159215.1, 11 pages.

* cited by examiner

LIQUID SUPPLY DEVICE AND LIQUID DISCHARGE DEVICE

CROSS-REFERENCE TO RELATED APPLICATIONS

This application is a continuation of U.S. patent application Ser. No. 16/750,945, filed on Jan. 23, 2020, which is based upon and claims the benefit of priority from Japanese Patent Application No. 2019-051160, filed on Mar. 19, 2019, the entire contents of each of which are incorporated herein by reference.

FIELD

Embodiments described herein relate generally to a liquid supply device and a liquid discharge device.

BACKGROUND

A liquid discharge device having a liquid circulation device to circulate liquid through a circulation path passing through a liquid discharge head is known. In general, liquids have a viscosity that increases at lower temperature. Increased viscosity may affect discharge performance, for example, the liquid may not be properly discharged from the liquid discharge head or the volume or number of liquid droplets may become unstable.

In some cases, a heater is provided in a liquid discharge device on the circulation path of the liquid discharge head on a primary side (e.g., upstream side) in order to heat the liquid to adjust the viscosity of a liquid such that discharge of the liquid through the head can be appropriately performed.

DETAILED DESCRIPTION

Embodiments provide a liquid supply device and a liquid discharge device capable of obtaining stable liquid discharge performance.

In general, according to an embodiment, a liquid supply device includes a first conduit, a second conduit, a pump, a heater, a filter, and a bypass conduit. The first conduit is connected to an upstream side of a liquid discharge head. The second conduit is connected to a downstream side of the liquid discharge head. The liquid is supplied through the first conduit to the liquid discharge head and recovered liquid from the liquid discharge head through the second conduit. The heater is provided along the first conduit. The filter is provided in the first conduit on a downstream side of the heater. The bypass conduit is connected between a portion of the first conduit upstream with respect to the filter and a portion of the second conduit.

Figure 1:
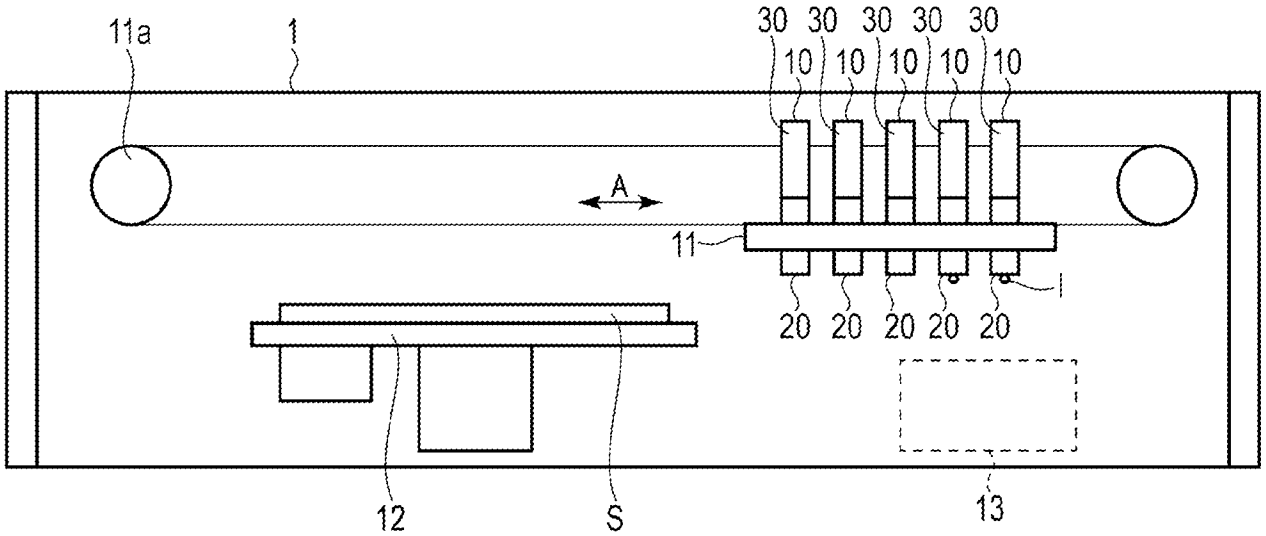
FIG. 1 illustrates a side view of an ink-jet recording apparatus according to a first embodiment.
Figure 2:
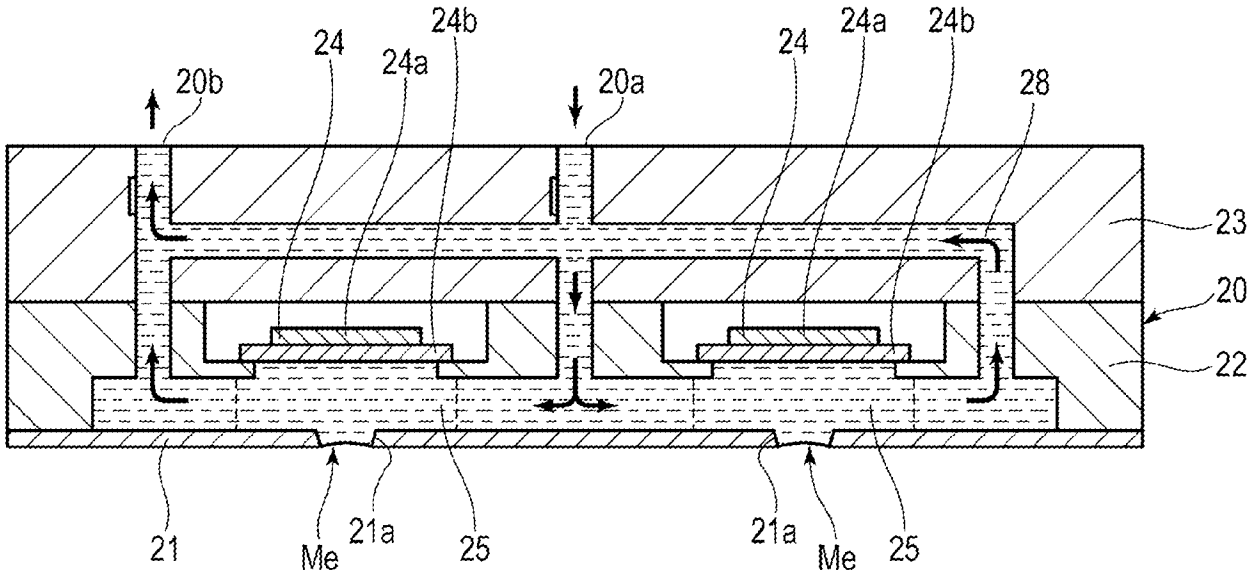
FIG. 2 illustrates a schematic cross-sectional view of a liquid discharge head according to the embodiment.
Figure 3:
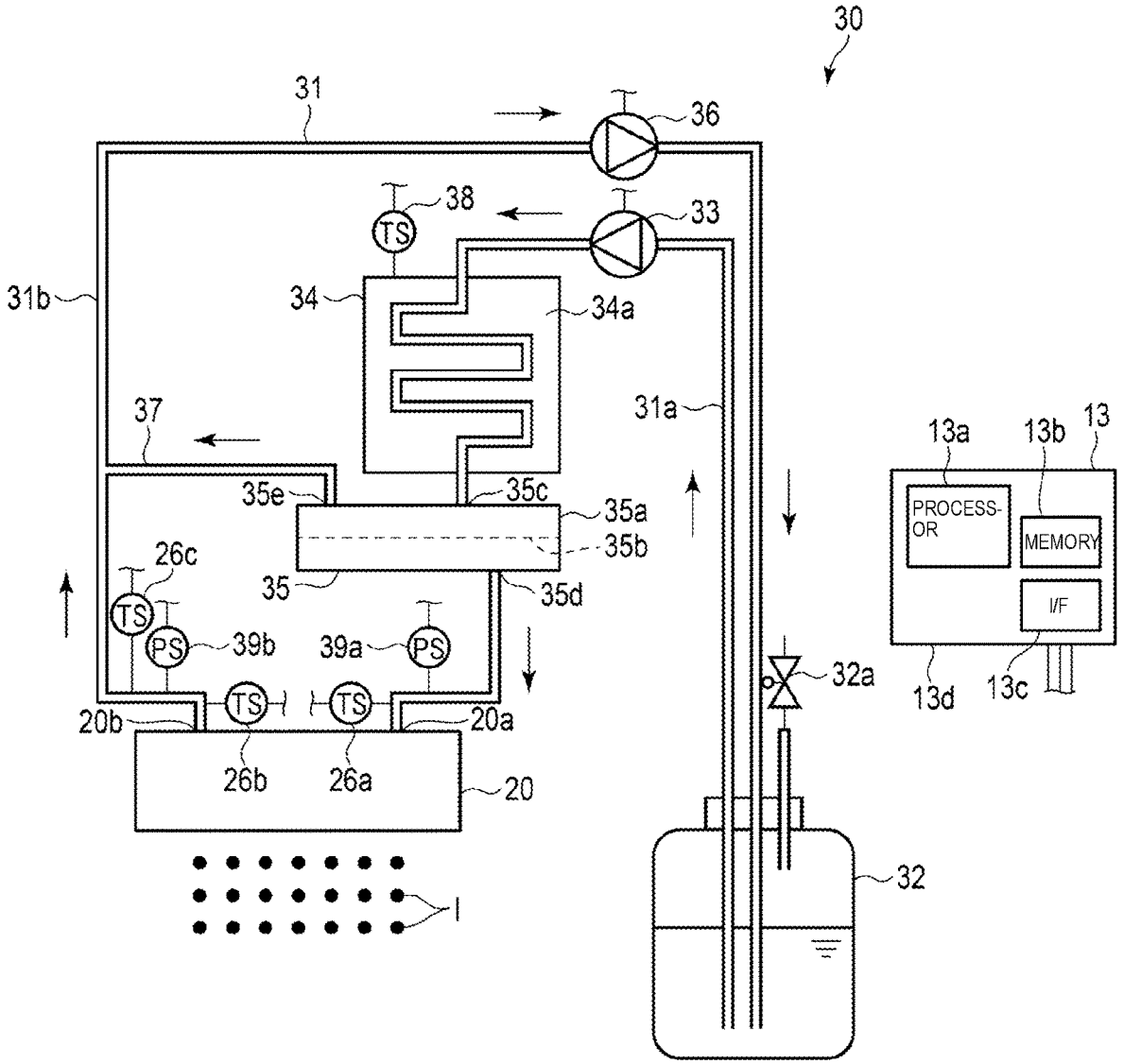
FIG. 3 illustrates a configuration of a liquid discharge device according to the embodiment.
Figure 4:
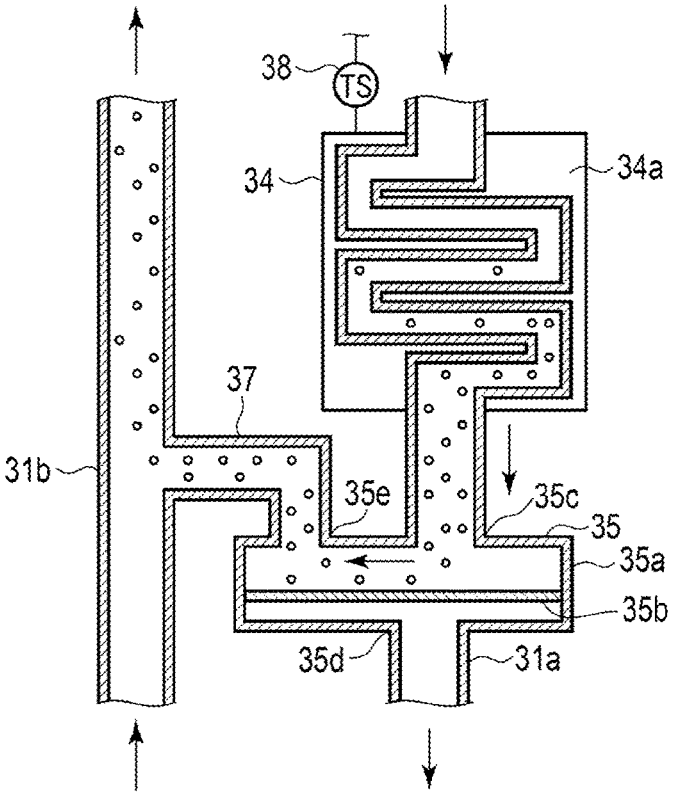
FIG. 4 illustrates a schematic cross-sectional view of a part of the liquid discharge device.

Hereinafter, a liquid discharge device 10 and an ink-jet recording apparatus 1 including the liquid discharge device 10 according to a first embodiment will be described with reference to FIGS. 1 to 4. FIG. 1 illustrates a side view of the ink-jet recording apparatus 1, and FIG. 2 illustrates a schematic cross-sectional view of a liquid discharge head 20. FIG. 3 illustrates a configuration of the liquid discharge device 10, and FIG. 4 illustrates a schematic cross-sectional view of a part of the liquid discharge device. The configuration of each drawing is appropriately enlarged, reduced, or omitted for explanation.

The ink-jet recording apparatus 1 (inkjet apparatus) shown in FIG. 1 includes a plurality of liquid discharge devices 10, a head support mechanism 11 configured to movably support the liquid discharge devices 10, a medium support mechanism 12 configured to movably support a recording medium S, and a control unit 13.

The plurality of liquid discharge devices 10 are disposed in parallel in a predetermined direction and supported by the head support mechanism 11. A liquid discharge device 10 integrally includes the liquid discharge head 20 and a circulation device 30 as a liquid supply and recovery device. The liquid discharge device 10 discharges, for example, ink I from the liquid discharge head 20 as liquid to form a desired image on the recording medium S disposed oppositely to the liquid discharge head.

The plurality of liquid discharge devices 10 respectively discharge different colors, for example, cyan ink, magenta ink, yellow ink, black ink, and white ink. However, the colors or other characteristics of ink I to be used are not limited. For example, transparent glossy ink and/or a special ink that develops color when exposed to infrared rays or ultraviolet rays can be discharged instead of the white ink. Although the liquid discharge devices 10 have different kinds of ink to be used, the liquid discharge devices otherwise have the same configuration as each other.

The liquid discharge head 20 shown in FIG. 2 is an inkjet head and includes a nozzle plate 21 including a plurality of nozzle holes 21*a*, a substrate 22, and a manifold 23 joined to the substrate 22. The substrate 22 is joined to the nozzle plate 21 and has a predetermined shape in which a predetermined flow path 28 including a plurality of ink pressure chambers 25 between the substrate and the nozzle plate 21 is formed. An actuator 24 is provided at a portion of the substrate 22 which faces each ink pressure chamber 25. The substrate 22 includes a partition wall disposed between the plurality of ink pressure chambers 25 in the same row. The actuator 24 is disposed oppositely to a nozzle hole 21*a*, and an ink pressure chamber 25 is formed between the actuator 24 and the nozzle hole 21*a*.

In the liquid discharge head 20, a predetermined flow path 28, which includes the ink pressure chambers 25 therein, is formed by the nozzle plate 21, the substrate 22, and the manifold 23. The liquid discharge head 20 includes a supply port 20*a*, which is an end portion of the flow path 28, on a primary side and a recovery port 20*b*, which is an end portion of the flow path 28, on a secondary side. The supply port 20*a* is connected to a first flow path 31*a* of the circulation device 30, and the recovery port 20*b* is connected to a second flow path 31*b*. An actuator 24 including electrodes 24*a* and 24*b* is provided at a portion of the substrate 22 which faces each ink pressure chamber 25. The actuator 24 is connected to a drive circuit. The liquid discharge head discharges ink from the nozzle holes 21*a* disposed oppositely to the actuator 24 through deformation of the actuator in response to a voltage under control of the control unit 13.

An ink temperature sensor 26*a* configured to detect the temperature of ink I in a flow path is provided in the supply port 20*a*, which is the end portion of the flow path 28 of the liquid discharge head 20 on the primary side. An ink temperature sensor 26*b* configured to detect the temperature of ink I in a flow path is provided in the recovery port 20*b*, which is the end portion of the flow path 28 of the liquid discharge head 20 on the secondary side. The ink temperature sensors 26*a* and 26*b* convert the temperature into an electrical signal using, for example, an NTC thermistor as a resistor of which electric resistance greatly changes with respect to the temperature change.

The circulation device 30 is integrally connected to an upper portion of the liquid discharge head 20 using connection parts made of metal. The circulation device 30 includes a predetermined circulation path 31 configured such that ink to pass through the liquid discharge head 20 can be circulated therein, and a tank 32, a first circulation pump 33, a heater 34, a filter portion 35, a second circulation pump 36, and a bypass flow path 37, which are provided in the circulation path 31.

The circulation path 31 may include a pipe made of metal or a resin material and/or a tube, for example, a PTFE tube, configured to cover the outer surface of the pipe. Hereinafter, a structure forming a path of a liquid may be referred to as a conduit. The circulation path 31 includes the first flow path 31*a* configured to connect the tank 32 to the supply port 20*a* of the liquid discharge head 20 and the second flow path 31*b* configured to connect the recovery port 20*b* of the liquid discharge head 20 to the tank 32. The circulation path 31 is a flow path which goes from the tank 32 to the supply port 20*a* of the liquid discharge head 20 via the first flow path 31*a* and returns to the tank 32 from the recovery port 20*b* of the liquid discharge head 20 via the second flow path 31*b*.

The first circulation pump 33 as a first pump, the heater 34, and the filter portion 35 are sequentially provided in the first flow path 31*a*. In addition, a first pressure sensor 39*a* which is a first pressure detector configured to detect the pressure of a liquid in the first flow path 31*a* is provided in the first flow path 31*a*.

The second circulation pump 36 as a second pump is provided in the second flow path 31*b*. A second pressure sensor 39*b* which is a second pressure detector configured to detect the pressure of a liquid in the second flow path 31*b* is provided in the second flow path 31*b*.

An ink temperature sensor 26*c* configured to detect the temperature of ink I in the flow path is provided in the second flow path 31*b*. The ink temperature sensor 26*c* converts the temperature into an electrical signal using, for example, an NTC thermistor as a resistor of which electric resistance greatly changes with respect to the temperature change.

The tank 32 is connected to the liquid discharge head 20 via the circulation path 31 and is configured so as to store ink. A primary side, which may be referred to as an upstream side, of the first flow path 31*a* and a secondary side (may be referred to as a downstream side, of the second flow path 31*b* are connected to the tank 32. An on-off valve 32*a* configured such that an air chamber in the tank 32 can open to atmospheric air is provided in the tank 32.

The on-off valve 32*a* is, for example, a normally closed solenoid on-off valve configured to open when the power is turned on and to be closed when the power is turned off. The on-off valve 32*a* is configured so that the air chamber of the tank 32 is open and closed with respect to atmospheric air by opening and closing the on-off valve under control of the control unit 13.

The first circulation pump 33 is provided between the liquid discharge head 20 and the tank 32 in the first flow path 31*a* of the circulation path 31. The first circulation pump 33 is composed, for example, of a piezoelectric pump and is connected to the drive circuit of the control unit 13 by wiring. The first circulation pump 33 is configured so as to be controlled under the control of the control unit 13 and sends ink to the liquid discharge head 20 disposed on the secondary side using a liquid feeding capability in response to the control.

The heater 34 is provided on a secondary side of the first circulation pump 33 of the first flow path 31*a* of the circulation path 31 and on a primary side of the filter portion 35. The heater 34 includes a heat source 34*a* which is a resistor formed, for example, of stainless steel foil or nichrome wire. The heat source 34*a* has, for example, a resistance of which an electric resistance value is several Ω (ohms) to several thousands Ω. The heat source 34*a* of the heater 34 is disposed in contact with the outer surface of a pipeline of the first flow path 31*a* flowing through the heater 34. If a current flows through the heat source 34*a* of the heater 34 under the control of the control unit 13, Joule heat is generated, and the heat source 34*a* is heated. If the heat source 34*a* is heated, the temperature of ink in the first flow path 31*a*, which flows through the heater 34, increases. The first flow path 31*a* in the heater 34 may be covered with metal such as aluminum to increase the heat capacity in order to make the temperature of ink in the first flow path 31*a* flowing through the heater 34 uniform. A temperature sensor 38 configured to detect the temperature of the heater 34 is provided in the heater 34.

The temperature sensor 38 converts the temperature into an electrical signal using, for example, an NTC thermistor as a resistor of which electric resistance greatly changes with respect to the temperature change.

The filter portion 35 includes a filter case 35*a* provided in the first flow path 31*a* and a filter 35*b* accommodated in the filter case 35*a*.

The filter case 35*a* is made, for example, of a PPS material in a bowl shape. The filter case 35*a* is provided in the first flow path 31*a*. The filter case 35*a* includes an inlet port 35*c*, which opens to the upper surface and communicates with the first flow path 31*a* on the tank 32 side as a primary side, an outlet port 35*d*, which opens to the lower surface and communicates with the first flow path 31*a* on the liquid discharge head 20 side as a secondary side, and a bypass port 35*e*, which opens to the upper surface and communicates with the bypass flow path 37.

The filter 35*b* is disposed in the filter case 35*a*, and a fluid entering from the inlet port 35*c* passes through the filter 35*b* before being discharged from the outlet port 35*d*. That is, the interior of the filter case 35*a* is partitioned vertically by the filter 35*b*, and a primary chamber on the upper side of the filter 35*b* and a secondary chamber on the lower side of the filter 35*b* are formed therein.

The inlet port 35*c* is connected to the tank 32 via the first flow path 31*a*, and the outlet port 35*d* is connected to the liquid discharge head 20 via the first flow path 31*a*. The bypass port 35*e* is connected to the second flow path 31*b* via the bypass flow path 37.

The filter 35*b* is, for example, a thin film-like metal filter provided with a large number of filter holes that are hole portions having a diameter of 10 μm. The filter 35*b* is disposed, for example, along a first surface direction orthogonal to the vertical direction, an outer peripheral edge of the filter is disposed in contact with the inner wall of the filter case 35*a*, and the interior of the filter case 35*a* is partitioned vertically into two sections. The filter 35*b* may be a metal mesh or a membrane filter made of resin.

The filter 35*b* is configured such that the difference between a pressure P1 on the primary side of the filter 35*b* and a pressure P2 on the secondary side of the filter 35*b* is smaller than a bubble point pressure Pb determined by a surface tension h of ink in the filter holes.

That is, the difference between the pressure P1 on the primary side of the filter 35*b* and the pressure P2 on the secondary side of the filter needs to exceed the bubble point pressure Pb determined by the surface tension h of ink in the filter holes in order to make air bubbles pass through the filter holes. That is, if the condition is set such that the difference between the pressure P1 on the primary side of the filter 35*b* and the pressure P2 on the secondary side of the filter 35*b* is smaller than the bubble point pressure Pb determined by the surface tension h of ink in the filter holes, it is possible to reliably capture air bubbles and to prevent the air bubbles from flowing to the secondary side.

In the filter 35*b* of the present embodiment, typically, the difference between the pressure P1 on the primary side of the filter 35*b* and the pressure P2 on the secondary side of the filter is less than or equal to about 1 kPa. In contrast, it has been determined by experiments and theoretical calculations that the bubble point pressure Pb determined by the surface tension h of generic ink (for example, oil-based ink, UV ink, and solvent ink) in the filter holes is about 10 kPa.

For example, if the bubble point pressure is set to Pb, the hole diameter of a filter hole is set to d, and the surface tension of ink is set to h, a relation of $Pb=k4h \cos \theta/d$ (k is a correction coefficient, θ is a contact angle between ink and the filter) is established among Pb, d, and h.

Accordingly, the filter 35*b* can more reliably capture air bubbles as long as pressure loss of the filter as set during designing occurs. The filter 35*b* captures not only air bubbles but also foreign substances such as dust in ink.

The second circulation pump 36 is disposed between the secondary side of the liquid discharge head 20 and the tank 32 in the second flow path 31*b* of the circulation path 31. The second circulation pump 36 is composed, for example, of a piezoelectric pump. The second circulation pump 36 is configured so as to be controlled under the control of the control unit 13 and sends ink to the tank 32 disposed on the secondary side using a liquid feeding capability in response to the control of the control unit 13.

The bypass flow path 37 includes a pipe made of metal or a resin material and a tube, for example, a PTFE tube, configured to cover the outer surface of the pipe.

The bypass flow path 37 is a flow path that connects the primary chamber of the filter case 35*a* to the flow path which is further on the primary side than the second circulation pump 36 of the second flow path 31*b* and is on the secondary side of the second pressure sensor 39*b* in a short circuit without passing through the liquid discharge head 20.

In the present embodiment, the bypass flow path 37 or the circulation path 31 is configured such that, for example, the flow path resistance on the bypass flow path 37 side is larger than the flow path resistance on the liquid discharge head 20 side. As an example, the bypass flow path or the liquid discharge head is configured so as to satisfy the condition that, for example, the flow path resistance on the bypass flow path 37 side is 2 to 5 times the flow path resistance on the liquid discharge head 20 side. Specifically, the bypass flow path 37 is configured to have a diameter smaller than that of the first flow path 31*a* and the second flow path 31*b* of the circulation path 31. The inner diameter of the circulation path 31 is set to about 2 to 6 times the inner diameter of the bypass flow path 37. The flow path diameter ϕ1 of the bypass flow path 37 is less than or equal to 0.7 mm, and the flow path diameter ϕ2 of the circulation path 31 is about 4.0 mm. In addition, the bypass flow path 37 is configured to have a length L1 of about 20 mm. The flow path resistance may be set, for example, by bending the pipeline or providing a resistance structure in the flow path in addition to the length and the diameter of the pipeline.

Each of the first pressure sensor 39*a* and the second pressure sensor 39*b* outputs a pressure as an electrical signal, for example, using a semiconductor piezoresistive pressure sensor. The semiconductor piezoresistive pressure sensor includes a diaphragm that receives pressure from the outside and a semiconductor strain gauge formed on the surface of the diaphragm. The semiconductor piezoresistive pressure sensor detects the pressure by converting change in electric resistance due to a piezoresistive effect generated in the strain gauge which is accompanied by deformation of the diaphragm due to the external pressure into an electrical signal.

The control unit 13 includes a processor 13*a*, a drive circuit configured to drive each element, a memory 13*b* configured to store various data, and a communication interface 13*c* for external communication. The processor 13*a*, the memory 13*b*, and the communication interface 13*c* are mounted on a control substrate 13*d* which is integrally mounted on the circulation device 30.

The processor 13*a* corresponds to a central portion of the control unit 13. The processor 13*a* controls each portion so as to perform various functions of the liquid discharge device 10 according to an operating system or an application program.

Drive circuits for the various pumps 33 and 36, the heater 34, and the on-off valve 32*a* of the circulation device 30 or drive circuits for various sensors 26*a*, 26*b*, 26*c*, 38, 39*a*, and 39*b*, and the liquid discharge head 20 are connected to the processor 13*a*.

The processor 13*a* has a function, for example, as a circulation unit configured to circulate ink by controlling the operation of the circulation pumps 33 and 36.

In addition, the processor 13*a* has a function as a pressure control unit configured to control the pressure of ink in the nozzle holes 21*a* by controlling the liquid feeding capability of the first circulation pump 33 and the second circulation pump 36 based on information detected by the first pressure sensor 39*a* and the second pressure sensor 39*b*.

In addition, the processor 13*a* has a function as a temperature control unit configured to control the temperature of a heater by controlling the drive circuit of the heater 34 based on information detected by the ink temperature sensors 26*a*, 26*b*, and 26*c*, and the temperature sensor 38. Only some of the plurality of temperature sensors 26*a*, 26*b*, 26*c*, and 38 may be used, or all the temperature sensors 26*a*, 26*b*, 26*c*, and 38 may be used.

In addition, the processor 13*a* has a function of opening and closing the air chamber of the tank 32 with respect to atmospheric air by controlling the opening and closing of the on-off valve 32*a*.

The memory 13*b* includes, for example, a program memory or a RAM. An application program or various setting values are stored in the memory 13*b*. Calculation expressions for calculating the pressure of ink in the nozzle holes 21*a*, target pressure ranges, and various setting values such as maximum values for adjusting each pump are stored in the memory 13*b* as control data used for controlling the pressure, for example.

The communication interface 13*c* transmits, for example, an input operation of a user or an instruction from the outside to the control unit 13.

If the liquid discharge device 10 according to the present embodiment below detects, for example, an input instruction from the outside or an instruction to start printing according to a command, an image is formed on the recording medium S by performing an ink discharge operation as a printing operation while making the liquid discharge device 10 reciprocate in a direction orthogonal to the conveyance direction of the recording medium S.

Specifically, the processor 13*a* operates to convey a carriage 11*a* (FIG. 1) provided in the head support mechanism 11 in the direction of the recording medium S, and the carriage reciprocates in the direction of an arrow A. In addition, the processor 13*a* sends an image signal in response to image data to the drive circuit of the liquid discharge head 20 and selectively drives the actuator 24 of the liquid discharge head 20 to discharge ink droplets on the recording medium S from the nozzle holes 21*a*.

The processor 13*a* operates to drive the first circulation pump 33 and the second circulation pump 36 to start an ink circulation operation as a printing operation. Here, the ink I in the first flow path 31*a* is distributed to ink flowing through the filter 35*b* and the liquid discharge head 20 and ink flowing through the bypass flow path 37 in response to the flow path resistance of the filter 35*b* and the liquid discharge head 20 and the flow path resistance of the bypass flow path 37.

A part of the ink I circulates so as to reach the liquid discharge head 20 from the tank 32 through the first flow path 31*a* and the filter 35*b* and to flow into the tank 32 again through the second flow path 31*b*.

Impurities contained in the ink I are removed by the filter 35*b* provided in the circulation path 31 through the circulation operation and do not reach the liquid discharge head 20.

In addition, a part of the remaining ink I is sent from the first flow path 31*a* to the second flow path 31*b* through the bypass flow path 37 without passing through the liquid discharge head 20 and flows into the tank 32.

The pressure of ink in the circulation path 31 on the primary side, that is, the inlet side of the bypass flow path 37 is set to be higher than that on the secondary side, that is, the outlet side of the bypass flow path 37 due to the pressure loss caused by the flow path resistance of the filter 35*b* and the liquid discharge head 20 and due to the pressure loss caused by the flow path resistance of the bypass flow path 37. Accordingly, ink flows from the primary side with a high pressure toward the secondary side with a low pressure in the circulation path 31 passing through the liquid discharge head 20 and the bypass flow path 37.

The processor 13*a* opens the on-off valve 32*a* of the tank 32 at a predetermined timing so that the tank opens to atmospheric air. The tank 32 opens to atmospheric air and always has a constant pressure, and therefore, pressure drop in the circulation path 31 due to consumption of ink in the liquid discharge head 20 is prevented. Here, if there is a concern about temperature rise in the on-off valve 32*a* due to opening of the on-off valve 32*a* for a long period of time, the on-off valve 32*a* may periodically open for a short period of time.

If the pressure in the circulation path 31 does not drop excessively, it is possible to keep the pressure of ink in the nozzle holes 21*a* constant even if the on-off valve 32*a* is closed. The solenoid-type on-off valve 32*a* is normally closed. For this reason, even if power supply to the apparatus is suddenly stopped due to power failure or the like, the on-off valve 32*a* can block the tank 32 from the atmospheric pressure by being instantaneously closed to seal the circulation path 31. Accordingly, it is possible to suppress the ink I from dripping from the nozzle holes 21*a* of the liquid discharge head 20.

The processor 13*a* in the printing operation controls the temperature. Specifically, the temperature of the heater 34 and the ink I is detected based on data transmitted from the temperature sensor 38 and the ink temperature sensors 26*a*, 26*b*, and 26*c*, and the heater 34 generates heat by driving the drive circuit of the heater 34 based on the detection results of the temperature sensor 38 and the ink temperature sensors 26*a*, 26*b*, and 26*c* to control the temperature of the heater 34 to an appropriate range. All or some of the plurality of temperature sensors 26*a*, 26*b*, 26*c*, and 38 may be used for controlling the temperature.

The control unit 13 turns on the drive circuit of the heater 34, for example, if the temperature of the heater 34 is lower than the target temperature of the heater, which is set in advance. The drive circuit of the heater 34 is turned off if the temperature of the heater 34 becomes higher than the target temperature of the heater due to the heating of the heater 34.

The control unit 13 controls the temperature of the heat source 34*a* of the heater 34, for example, based on the ink temperature detected at positions of the supply port 20*a* (as an end portion of the flow path 28 of the liquid discharge head 20 on the primary side), the recovery port 20*b* (as an end portion of the flow path 28 of the liquid discharge head 20 on the secondary side), and the second flow path 31*b* so that the temperature reaches a target deaeration temperature suitable for deaeration when the ink I passes through the heater 34, the ink I is then cooled by natural heat dissipation after passing through the heater 34, and the temperature reaches a target printing temperature suitable for printing as the ink passes through the vicinity of the nozzle holes 21*a*. In addition, the temperature of the heat source 34*a* is set to a temperature (for example, 110° C.) that satisfies conditions under which ink does not deteriorate, as an upper limit. For example, the target deaeration temperature is a value which is higher than the target printing temperature but lower than the upper limit temperature.

For example, if the ink I cools, that is, if the ink temperature detected at the supply port 20*a*, the recovery port 20*b*, and the second flow path 31*b* is lower than or equal to a predetermined reference temperature (for example, 35° C.) which is lower than a target printing temperature (for example, 40° C.), the control unit 13 controls the temperature of the heat source 34*a* to be close to an upper limit of the set heat source temperature to rapidly heat the ink I.

In addition, if the ink temperature detected at the supply port 20*a*, the recovery port 20*b*, and the second flow path 31*b* is higher than or equal to a predetermined reference temperature (for example, 35° C.), which is lower than a target printing temperature (for example, 40° C.), the control unit 13 performs control so that the ink temperature detected at the supply port 20*a* (as an end portion of the flow path 28 of the liquid discharge head 20 on the primary side), the recovery port 20*b* (as an end portion of the flow path 28 of the liquid discharge head 20 on the secondary side), and the second flow path 31*b* is stabilized at the target printing temperature (for example, 40° C.) by gradually changing the set heat source temperature of the heat source 34*a*. In this process, all of the three ink temperature sensors 26*a*, 26*b*, and 26*c* may be used, or only some of the sensors may be used.

As a result, the temperature of the ink I when the ink passes through the heater 34 is stabilized at a set heat source temperature to a degree of becoming a target deaeration temperature, for example, at a temperature which is higher than the target printing temperature by a predetermined value (10° C. to 20° C.)

By such temperature control, it is possible to promote deaeration by heating the ink I, but not excessively so, to be a temperature close to target deaeration temperature immediately after the ink passes through the heater 34 and then to allow the temperature of the ink to cool by natural cooling to the target printing temperature suitable for printing by the time the ink passes through the nozzle holes 21*a*. That is, by controlling the temperature of the heat source 34*a* based on the temperature of the ink I, it is possible to stabilize the temperature of the ink I and to perform the temperature control by which the temperature of ink becomes optimal once the ink I passes through the vicinity of the nozzle holes 21*a*. In addition, the ink I can be prevented from deteriorating by setting an upper limit of the temperature of the heat source 34*a*.

The ink I is at a target deaeration temperature higher than a target printing temperature immediately after passing through the heater 34, but then cools to a temperature close to the target printing temperature through natural cooling as the ink travels to the liquid discharge head 20. The first flow path 31*a* is designed so as to satisfy the required natural heat dissipation conditions. Specifically, the length and the inner diameter of a flow path, the material (a pipe made of metal or a resin material and a tube, for example, a PTFE tube, which covers the outer surface of a pipe) constituting a flow path are set such that the ink I at a target deaeration temperature at a position on the flow path immediately after passing through the heater 34 naturally cools to a temperature close to the target printing temperature when the ink reaches the liquid discharge head 20.

In addition, the processor 13*a* detects pressure data transmitted from the first pressure sensor 39*a* and the second pressure sensor 39*b* and calculates the pressure of ink in the nozzle holes 21*a* using a predetermined arithmetic operation based on the pressure data, on the primary side and the secondary side, which is transmitted from the pressure sensors 39*a* and 39*b*, as pressure control processing. By calculating the drive voltage based on the calculated ink pressure Pn in the nozzle holes 21*a* and driving the first circulation pump 33 and the second circulation pump 36 so that the ink pressure Pn in the nozzle holes 21*a* becomes an appropriate value, negative pressure is maintained to such a degree that the ink I does not leak from the nozzle holes 21*a* of the liquid discharge head 20 and air bubbles are not sucked from the nozzle holes 21*a*, and a meniscus Me is maintained.

Thereafter, the processor 13*a* performs feedback control for the pressure until a command to end the circulation is detected. If an instruction to end the circulation is detected, the processor 13*a* closes the on-off valve 32*a* of the tank 32 to seal the tank 32, stops the first circulation pump 33 and the second circulation pump 36, and ends the circulation processing.

According to the inkjet apparatus and the liquid discharge device according to the present embodiment, the heater 34 is provided on the primary side of the liquid discharge head 20 and the filter 35*b* is provided on the secondary side of the heater 34. Therefore, air bubbles generated in the heater 34 can be suppressed from flowing to the liquid discharge head 20 disposed on the secondary side of the filter 35*b* by capturing the air bubbles using the filter 35*b*.

Here, generation of air bubbles in the circulation path 31, a method for removing the air bubbles, and the principle of deaeration of ink will be described. The ink I flowing in the heater 34 is heated by the heater 34, and the temperature thereof increases. If the temperature of the ink I increases, the solubility of gas decreases. Gas (mainly oxygen, nitrogen, or carbon dioxide) that cannot be dissolved in the ink I appears as bubbles and flows along with the ink I.

For example, if there is no bypass flow path 37 connecting the primary side of the filter 35*b* and the flow path on the secondary side of the liquid discharge head 20, air bubbles captured by the filter 35*b* continue to accumulate on the primary side of the filter 35*b*. If gas accumulates on the primary side of the filter 35*b*, the contact area between ink and the filter 35*b* decreases, the flow rate of ink per unit area which passes through the filter 35*b* increases, and the pressure loss of the filter 35*b* increases. Accordingly, the total flow rate of ink decreases, and the amount of ink necessary for stable discharge is not supplied to the liquid discharge head 20, which leads to unstable discharge. Furthermore, if the amount of gas accumulating on the primary side of the filter 35*b* increases and the pressure loss of the filter 35*b* continues to increase, the difference between the pressure P1 on the primary side of the filter 35*b* and the pressure P2 on the secondary side of the filter 35*b* can exceed the bubble point pressure Pb determined by the surface tension h of ink in the filter holes, and gas on the primary side of the filter 35*b* passes through the filter holes. The gas passing through the filter holes continues to flow along with ink as air bubbles and may cause unstable discharge of ink when the ink (including the bubbles) passes through the vicinity of the nozzle holes 21*a* of the liquid discharge head 20.

In contrast, the liquid discharge device 10 according to the present embodiment can stabilize the discharge performance of the liquid discharge head 20 by connecting the space on the secondary side of the heater 34 on the first flow path 31*a* and on the primary side of the filter 35*b* to the space on the primary side of the second circulation pump 36 on the second flow path 31*b* using the bypass flow path 37 as a short circuit (bypass) path not passing through the liquid discharge head 20. That is, after air bubbles generated in the heater 34 are captured by the filter 35*b*, the air bubbles are rapidly sent to the second flow path 31*b* through the bypass flow path 37 along with liquid without passing through the liquid discharge head 20 and thus flow into the tank 32. That is, there is no gas accumulating on the primary side of the filter 35*b*. Therefore, it is possible to secure the contact area between the ink and the filter 35*b* and to suppress large pressure loss of the filter 35*b*. Accordingly, the total flow rate of ink that can pass through the filter 35*b* can be secured, and a stable amount of ink can be supplied. Furthermore, gas on the primary side of the filter 35*b* can be prevented from passing through the filter holes. Therefore, air bubbles do not flow into the liquid discharge head 20, and discharge of ink is stabilized.

Furthermore, in the liquid discharge device 10 according to the above-described embodiment, air bubbles that reach the tank 32 rise due to buoyancy and are eliminated by being mixed with an air layer of the tank 32. Accordingly, gas (mainly oxygen, nitrogen, or carbon dioxide) that becomes air bubbles in the heater 34 and is dissolved in the ink can be suppressed from being dissolved in the ink again. Therefore, the gas dissolution amount in the ink flowing through the liquid discharge device 10 gradually decreases, and the ink is deaerated.

If the ink is deaerated, cavitation due to the movement of the actuator 24 of the liquid discharge head 20 during discharge is less likely to occur. Therefore, the liquid discharge performance is stabilized. That is, according to the liquid discharge device 10, air bubbles generated in the heater 34 are removed, and at the same time, the liquid discharge device has an effect of preventing occurrence of cavitation in the nozzle holes 21*a* of the liquid discharge head 20 as the liquid discharge device acts as a deaeration device.

In general, there is, for example, purge processing in which the flow rate of ink and the filter pressure loss are increased to a degree that air bubbles accumulated in a filter can pass through the filter to discharge the air bubbles flowing downstream of the filter from the nozzle holes of the liquid discharge head as a method for processing air bubbles captured by the filter. However, in the purge processing, it is necessary to interrupt the printing to move the liquid discharge head to a maintenance position. Therefore, it is difficult to perform continuous printing. In addition, a large amount of ink is discarded in the purge processing, which is not economically, environmentally preferable. Furthermore, the nozzle surface needs to be wiped or sucked in order to make the nozzle surface clean after the purge processing, which causes deterioration in processing efficiency or an increase in cost. In the liquid discharge device 10 according to the present embodiment, air bubbles captured by the filter portion 35 are sent to the tank 32 without flowing through the liquid discharge head 20 and are discharged from the tank 32. Therefore, it is possible to improve the processing efficiency and reduce costs compared to the method for discharging ink from the nozzle holes through the purge processing, for example. Accordingly, ink can be efficiently used.

In addition, the liquid discharge device 10 can appropriately maintain the flow rate of ink passing through the liquid discharge head 20 and ink flowing through the bypass flow path 37 by appropriately setting the flow path resistance of the bypass flow path 37.

According to the above-described embodiment, stable performance of discharging a liquid can be obtained.

The exemplary embodiment is not limited to the configuration of the above-described embodiment.

For example, the configuration in which the flow path direction of the bypass flow path 37 connected to the filter case 35*a* faces upward, the bypass port 35*e* opens to the upper surface of the filter case 35*a*, and the bypass flow path 37 extends upward is exemplified in the liquid discharge device 10 according to the above-described embodiment. However, the exemplary embodiments are not limited thereto. For example, the inclination angle between the flow path direction from a bypass port 135*e* on an air bubble discharge side of the filter portion 135 and the surface direction of a filter 135*b* may be configured to be less than 90 degrees like a filter portion 135 shown in FIG. 5 as another embodiment.

Figure 5:
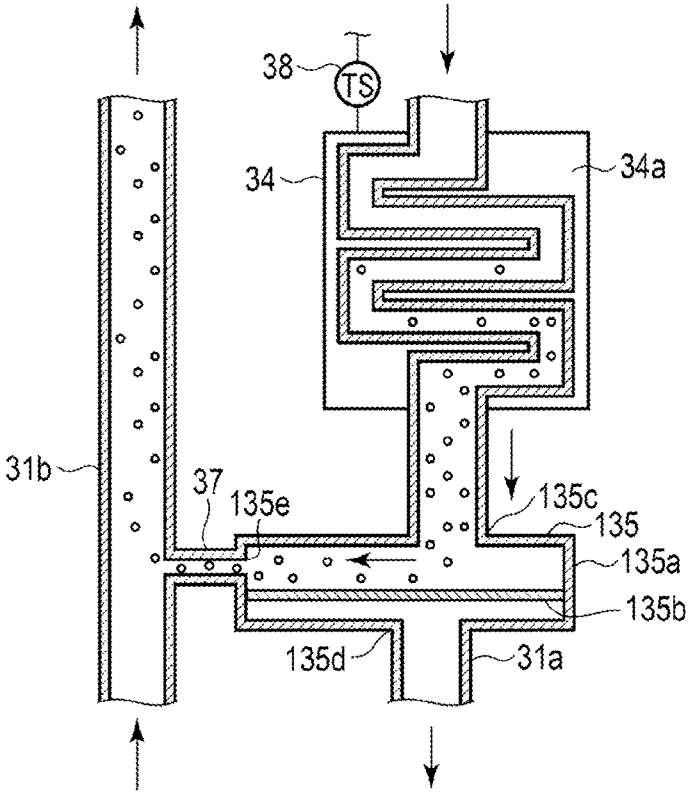
FIG. 5 illustrates a schematic cross-sectional view of a part of a liquid discharge device according to another embodiment.

The filter portion 135 shown in FIG. 5 includes a filter case 135*a* provided in the first flow path 31*a* and a filter 135*b* accommodated in the filter case 135*a*. The filter case 135*a* includes an inlet port 135*c* which opens to the upper surface and communicates with the first flow path 31*a* on the tank 32 side as a primary side, an outlet port 135*d* which opens to the lower surface and communicates with the first flow path 31*a* on the liquid discharge head 20 side as a secondary side, and the bypass port 135*e* which opens to a side wall portion of the filter case 135*a* and communicates with the bypass flow path 37. The flow path direction of the filter portion 135 follows sideways, that is, in the surface direction of the filter 135*b*. That is, in the filter portion 135, the bypass port 135*e* is provided at a position which is close to the filter 135*b* and is in the side wall portion of the filter case 135*a*, and the bypass flow path 37 extends in parallel to the filter 135*b*. In this case, air bubbles flowing on the surface of the filter 135*b* easily flow through the bypass flow path 37 and are easily guided to the outlet side. Therefore, discharge of the air bubbles can be promoted.

In addition, for example, the configuration in which liquid flows downward from the first flow path 31*a* on the primary side of the filter portion 35 into the filter case 35*a* is exemplified in the liquid discharge device 10 according to the above-described embodiment, but the exemplary embodiments are not limited thereto. For example, the inclination angle between the flow path direction of the first flow path 31*a* facing an inlet port 235*c* of a filter portion 235 and the surface direction of a filter 235*b* may be configured to be less than 90 degrees like the filter portion 235 shown in FIG. 6 as still another embodiment.

Figure 6:
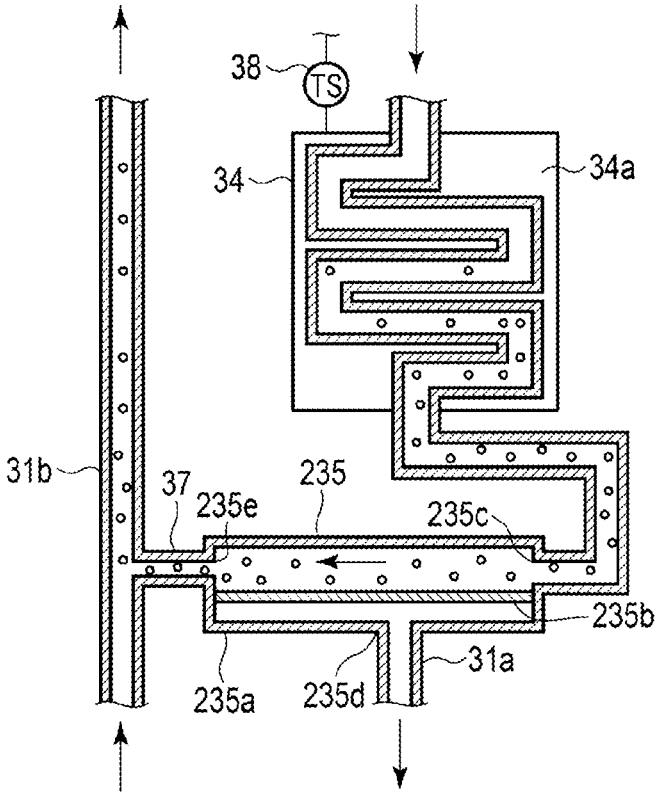
FIG. 6 illustrates a schematic cross-sectional view of a part of a liquid discharge device according to still another embodiment.

The filter portion 235 shown in FIG. 6 includes a filter case 235*a* provided in the first flow path 31*a* and a filter 235*b* accommodated in the filter case 235*a*. The filter case 235*a* includes the inlet port 235*c* which opens to a side wall in the vicinity of the filter 235*b* and communicates with the first flow path 31*a* on the tank 32 side as a primary side, an outlet port 235*d* which opens to the lower surface and communicates with the first flow path 31*a* on the liquid discharge head 20 side as a secondary side, and a bypass port 235*e* which opens to a side wall portion of the filter case 235*a* and communicates with the bypass flow path 37. The inlet port 235*c* in the filter portion 235 is disposed on the side wall in the vicinity of the filter 235*b* of the filter case 235*a*, and the first flow path 31*a* extends in the lateral direction. With such a configuration, a fluid can flow along the surface direction of the filter case 235*b* from one side to the other side in the filter case 235*a*, and air bubbles captured on the surface of the filter 235*b* are easily guided to the bypass flow path 37 side, thereby promoting discharge of the air bubbles.

In addition, in order to prevent air bubbles from being dissolved in ink again before the air bubbles captured by the filter 35*b* are eliminated by being mixed with an air layer of the tank 32, a heater may be additionally provided, for example, at a predetermined position such as a space between the tank 32 and a junction of the second flow path 31*b* with the bypass flow path 37.

In addition, a configuration in which the flow path diameter of the bypass flow path 37 is smaller than that of the circulation path 31 that is a mainstream and the flow path resistance on the bypass flow path 37 side is high is exemplified in the above-described embodiment, but the exemplary embodiments are not limited thereto. For example, if the flow rate can be secured, the diameter of the bypass flow path 37 can be made larger than that of the circulation path 31 to reduce the flow path resistance on the bypass flow path 37 side. By reducing the flow path resistance on the bypass flow path 37 side, the flow rate of ink in the bypass flow path 37 increases, thereby promoting discharge of air bubbles.

In addition, the liquid to be discharged is not limited to ink. For example, various liquids such as liquid containing conductive particles for forming a wiring pattern of a printed wiring board can be applied thereto.

The liquid discharge head 20 may have, in addition to the above, a structure in which, for example, ink droplets are discharged through deformation of a vibration plate with static electricity or a structure in which ink droplets are discharged from nozzle holes using heat energy such as a heater.

In addition, an example in which the liquid discharge device 10 is used in the ink-jet recording apparatus 1 is shown in the above-described embodiments, but the exemplary embodiments are not limited thereto. For example, the liquid discharge device can also be used in a 3D printer and an industrial manufacturing machine, and for medical use, and reduction in size, weight, and cost can be achieved.

In addition, a configuration in which the circulation pumps 33 and 36 are respectively provided on the primary side and the secondary side of the liquid discharge head 20 is exemplified in the liquid discharge device 10 according to the above-described embodiments. However, the exemplary embodiments are not limited thereto, and one circulation pump may be used. Even in this case, the same function as the above-described embodiments can be performed by adjusting the positive and negative pressure states of the circulation path by pushing and pulling a fluid.

According to at least one of the above-described embodiments, stable performance of discharging a liquid can be obtained.

While a certain embodiment has been described, the embodiment has been presented by way of example only, and is not intended to limit the scope of invention. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

What is claimed is:

1. A liquid supply device, comprising:

a first conduit connected to an upstream side of a liquid discharge head;

a second conduit connected to a downstream side of the liquid discharge head;

a pump configured to supply liquid through the first conduit to the liquid discharge head and recover the liquid from the liquid discharge head through the second conduit;

a heater provided along the first conduit;

a filter case included in the first conduit on a downstream side of the heater, the filter case including an inlet port and a bypass port on a first surface and an outlet port on a second surface opposite to the first surface, the inlet port being connected to an upstream portion of the first conduit with respect to the filter case and the outlet port being connected to a downstream portion of the first conduit with respect to the filter case;

a filter provided in the filter case between the first surface and the second surface; and a bypass conduit connected between the bypass port of the filter case and a portion of the second conduit.

2. The liquid supply device according to claim 1, further comprising:

a liquid tank connected to the liquid discharge head by the first conduit and the second conduit, the liquid being supplied from the liquid tank to the liquid discharge head through the first conduit and recovered to the liquid tank from the liquid discharge head through the second conduit.

3. The liquid supply device according to claim 2, wherein the liquid tank is vented to atmosphere.

4. The liquid supply device according to claim 1, wherein the first surface is an upper surface of the filter case, and the second surface is a bottom surface of the filter case.

5. The liquid supply device according to claim 4, wherein the filter extends horizontally.

6. The liquid supply device according to claim 4, wherein the filter separates a space in the filter case into an upstream space connected to the upstream portion of the first conduit and the bypass conduit and a downstream space connected to the downstream portion of the first conduit.

7. The liquid supply device according to claim 4, wherein the bypass conduit extends upward from the bypass port of the filter case.

8. The liquid supply according to claim 4, wherein the upstream portion of the first conduit with respect to the filter case extends downward to the filter case.

9. The liquid supply according to claim 4, wherein the downstream portion of the first conduit with respect to the filter case extends downward from the filter case.

10. The liquid supply device according to claim 1, wherein a flow resistance of the bypass conduit is greater than a flow resistance of a downstream portion of the first conduit with respect to the filter case.

11. A liquid discharge apparatus, comprising:

a liquid supply device according to claim 1; and a liquid discharge head connected to the liquid supply device.

12. A printer, comprising:

a media conveyer configured to convey a medium;

a print head configured to discharge ink onto the medium conveyed by the media conveyer; and a liquid supply device configured to supply ink to the print head for discharge, the liquid supply device comprising:

a first conduit connected to an upstream side of the print head;

a second conduit connected to a downstream side of the print head;

a pump configured to supply ink through the first conduit to the print head and recover the ink from the print head through the second conduit;

a heater provided along the first conduit;

a filter case included in the first conduit on a downstream side of the heater, the filter case including an inlet port and a bypass port on a first surface and an outlet port on a second surface opposite to the first surface, the inlet port being connected to an upstream portion of the first conduit with respect to the filter case and the outlet port being connected to a downstream portion of the first conduit with respect to the filter case;

a filter provided in the filter case between the first surface and the second surface; and a bypass conduit connected between the bypass port of the filter case and a portion of the second conduit.

13. The printer according to claim 12, further comprising:

a liquid tank connected to the print head by the first conduit and the second conduit, the ink being supplied from the liquid tank to the print head through the first conduit, and recovered to the liquid tank from the print head through the second conduit.

14. The printer according to claim 13, wherein the liquid tank is vented to atmosphere.

15. The printer according to claim 12, wherein the first surface is an upper surface of the filter case, and the second surface is a bottom surface of the filter case.

16. The printer according to claim 15, wherein the filter extends along an ink discharge surface of the print head.

17. The printer according to claim 15, wherein the filter separates a space in the filter case into an upstream space connected to the upstream portion of the first conduit and the bypass conduit and a downstream space connected to the downstream portion of the first conduit.

18. The printer according to claim 15, wherein the bypass conduit extends upward from the bypass port of the filter case.

19. The printer according to claim 15, wherein the upstream portion of the first conduit with respect to the filter case extends downward to the filter case.

20. The printer according to claim 15, wherein the downstream portion of the first conduit with respect to the filter case extends downward from the filter case.

* * * * *